US007797872B1

(12) United States Patent
Lynch

(10) Patent No.: US 7,797,872 B1
(45) Date of Patent: Sep. 21, 2010

(54) CLAMP FOR RETAIL DISPLAY OF EXTRA FIREARM BARREL

(75) Inventor: Thomas Lynch, Hamden, CT (US)

(73) Assignee: O.F. Mossberg & Sons, Inc., North Haven, CT (US)

( * ) Notice: Subject to any disclaimer, the term of this patent is extended or adjusted under 35 U.S.C. 154(b) by 477 days.

(21) Appl. No.: 11/936,165

(22) Filed: Nov. 7, 2007

Related U.S. Application Data

(60) Provisional application No. 60/864,625, filed on Nov. 7, 2006.

(51) Int. Cl.
*F41A 21/08* (2006.01)

(52) U.S. Cl. ..... 42/77; 211/64

(58) Field of Classification Search ..... 42/77; 211/64

See application file for complete search history.

(56) References Cited

U.S. PATENT DOCUMENTS

| | | | | |
|---|---|---|---|---|
| 990,575 | A * | 4/1911 | Marble | 42/77 |
| 1,092,763 | A * | 4/1914 | Bourdelles | 89/16 |
| 1,791,590 | A * | 2/1931 | Arbuckle | 42/77 |
| 7,137,511 | B1 * | 11/2006 | Crowell et al. | 211/4 |
| 2002/0139241 | A1 * | 10/2002 | Butler | 89/191.01 |

* cited by examiner

*Primary Examiner*—Stephen M Johnson
(74) *Attorney, Agent, or Firm*—Holland & Bonzagni, P.C.; Donald S. Holland, Esq.

(57) ABSTRACT

A display clamp, and related method, are disclosed for removably attaching a second, interchangeable barrel to a fully assembled long gun (i.e., a shotgun or rifle) for display purposes only, wherein the extra barrel's gas cylinder or lug is suspended from the long gun's magazine tube, and held in place by the shotgun's/rifle's removable magazine cap. The method and apparatus allow a retail store (or buyer) to display the firearm and extra barrel as a combination unit either vertically or horizontally oriented within display cases.

5 Claims, 2 Drawing Sheets

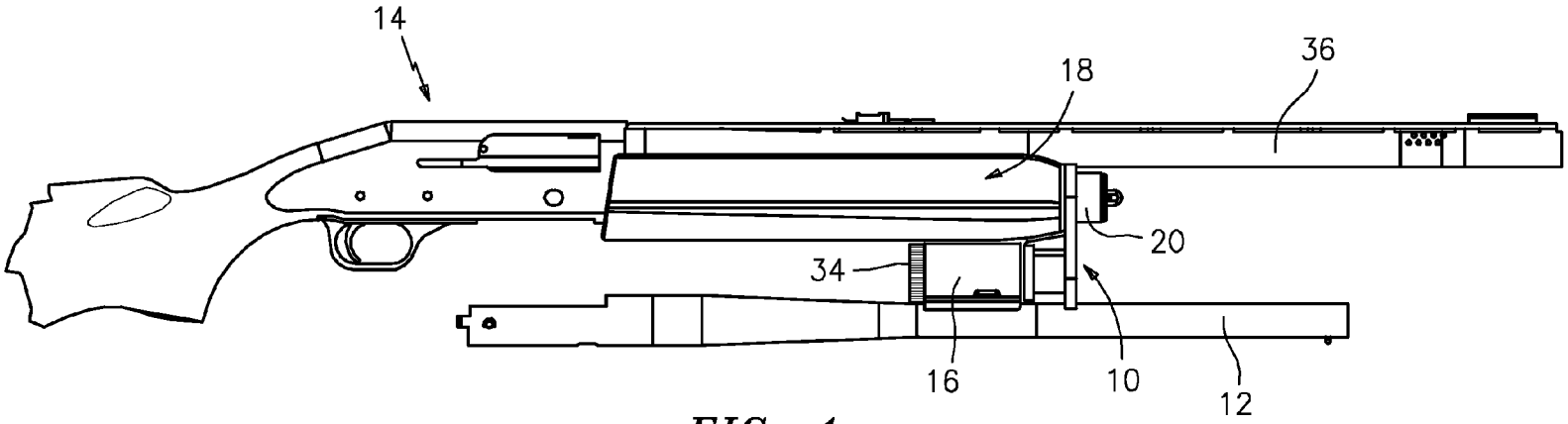
FIG. 1
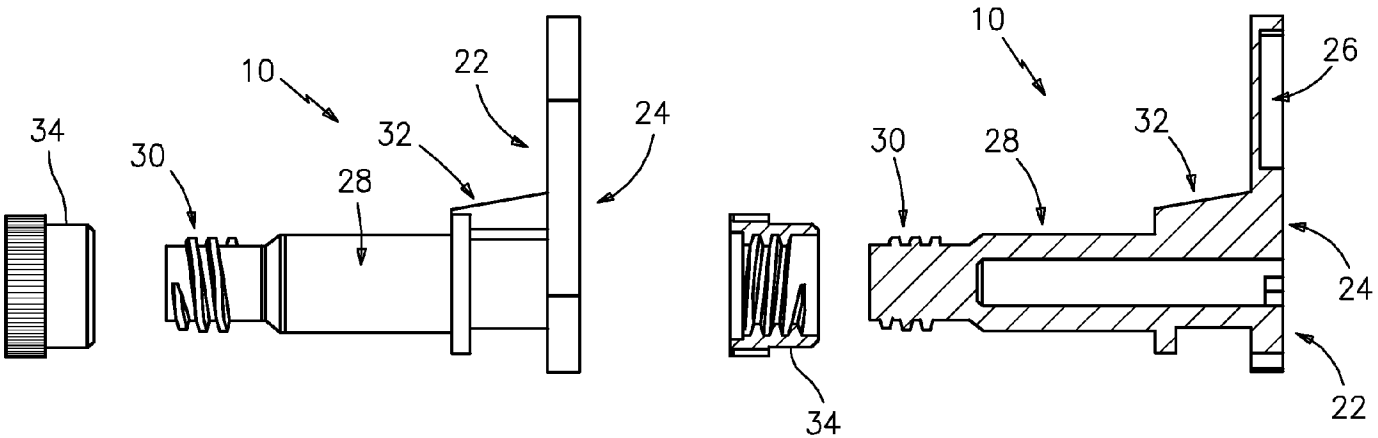
FIG. 3
FIG. 2

CLAMP FOR RETAIL DISPLAY OF EXTRA FIREARM BARREL

CROSS-REFERENCE TO RELATED APPLICATION

This application is based on an earlier U.S. Provisional Patent Application, Ser. No. 60/864,625, filed Nov. 7, 2006. Applicant claims the benefit of priority from that provisional application. Applicant also hereby incorporates the disclosure from that earlier application by reference.

FIELD OF INVENTION

The present invention relates in general to devices and processes for displaying or holding an extra barrel for shotguns or rifles. More particularly, it relates to clamps and methods for displaying such firearms with an extra, interchangeable barrel at retail sales establishments.

BACKGROUND OF THE INVENTION

Some shotguns are sold as combination packs, i.e., a shotgun having two removable, interchangeable barrels. An example of such a shotgun is the 835® Turkey/Deer COMBO model sold by O.F. Mossberg & Sons, Inc. of North Haven, Conn. USA. That model includes a 12 gauge smooth bore barrel for shot shells and a fully rifled barrel for slugs.

It is common practice for retail stores to display an assembled shotgun portion of a combination pack and not the additional barrel. Similarly, the owner of a combination pack will often store a shotgun in a display case at home, with the extra barrel loose inside the case. Sometimes the extra barrels get misplaced, or left behind.

Some owners attach extra barrels, in their display cases, by string or twine. Wouldn't it be nice if there was something sturdier to store the barrels side-by-side, for display and easy retrieval of the extra barrel?

Accordingly, it is a primary object of the present invention to provide a display clamp for attaching a second barrel to a shotgun for display purposes only, allowing a retail store to display the firearm and clamped extra barrel as a combination unit, either in an upright position or horizontally.

It is another primary object to provide a method for attaching a second barrel to a shotgun for display purposes only, allowing a retail store to display the firearm (and attached extra barrel) as a combination unit either horizontally or upright within a display case.

It is another object to provide a display clamp which can be used by a firearm owner to store an extra barrel in a display case at home, for display and easy retrieval.

It is yet another object to provide a display clamp which can be expanded to display other accessories on a firearm, such as choke tubes.

SUMMARY OF THE INVENTION

In the present application, a display clamp is disclosed for removably attaching a second barrel to a shotgun or rifle for display purposes only, whereby the attachment is made by clamping onto the second barrel's gas cylinder or lug, allowing a retail store (or buyer) to display the firearm as a combination unit. The extra barrel is attached to the magazine tube of the fully assembled shotgun or rifle, and held in place by the shotgun's/rifle's magazine cap. The invention can also be thought of as a method.

DESCRIPTION OF THE DRAWINGS

The above and other objects of this invention will become more readily understood upon reading the following description and accompanying drawings, in which:

FIG. 1 shows Applicant's preferred display clamp removably attached to a fully assembled shotgun's magazine tube, secured by the magazine cap, and clamped to the extra, interchangeable barrel via the extra barrel's gas cylinder;

FIG. 2 is a side view of the display clamp of FIG. 1, when not attached to a shotgun or extra barrel;

FIG. 3 is a cross-sectional view of the FIG. 2 clamp; and

DETAILED DESCRIPTION OF THE PREFERRED EMBODIMENTS

Figure 4:
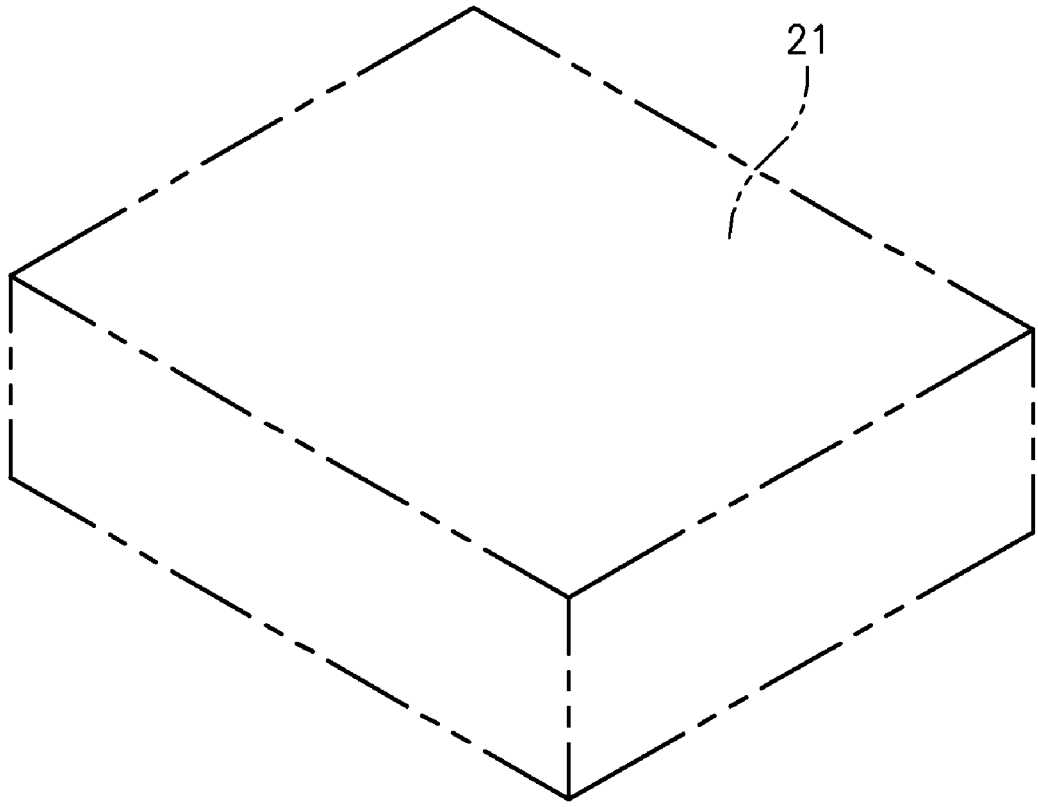
FIG. 4 is a block representing a generic display case for shotguns.

FIGS. 1-3 show a preferred embodiment of a "CLAMP FOR RETAIL DISPLAY OF EXTRA FIREARM BARREL". Those drawings show a display clamp 10 for removably attaching a second, interchangeable barrel 12 to a fully assembled long gun 14 (e.g., the illustrated semi-automatic shotgun) for display purposes only, wherein the extra barrel's gas cylinder or lug 16 is suspended from the long gun's magazine tube 18, and held in place by the long gun's removable magazine cap 20. This allows a retail store (or buyer) to display the long gun 14 and extra barrel 12 as a combination unit either vertically or horizontally oriented within standard display cases (e.g., 21 in FIG. 4).

As used in the firearm industry, the term "long gun" encompasses rifles and shotguns. Where the following description specifically refers to shotguns, it also applies to rifles with underlying magazine tubes.

FIGS. 2 and 3 best show the different parts of Applicant's preferred display clamp 10. Those parts comprise: an angled barrel bracket 22 having a flat side 24 with a circular hole 26 designed to slide onto a forward end of the magazine tube 18, where the flat side 24 is retained by the magazine cap 20; a cylindrical barrel support 28 integral with and perpendicular to the flat side 24, wherein the barrel support 28 has a threaded stub end 30; an angle brace 32, integral with both the flat side 24 and barrel support 28; and a knurled retaining cap 34 which screws onto the threaded stub end 30 of the barrel support 28. Preferably, these are molded plastic parts. The preferred plastic resin is ABS (Acrylonitrile Butadine Styrene). Other suitable resins could be used instead, such as polypropylene, nylon, or polycarbonate.

In operation, the barrel bracket 22 is first retained or clamped on the illustrated shotgun (see FIG. 1) by the magazine cap 20. Afterwards, the gas cylinder 16 of the extra barrel 12 is slipped onto the barrel support 28, and the retaining cap 34 is screwed onto the barrel support 28.

When connected (see FIG. 1), the barrel bracket 22 is retained on the shotgun by the magazine cap 20. The second barrel 12 is retained on the bracket by the retaining cap 34. In this combination, the second barrel 12 is substantially parallel to an interchangeable, first barrel 36 of the assembled shotgun 14, whether the combination is displayed horizontally or vertically.

Applicant's invention has a similar purpose to the invention disclosed in a pending U.S. patent application Ser. No. 10/908,349, for a "DISPLAY CLAMP ASSEMBLY FOR EXTRA FIREARM BARRELS," filed on May 9, 2005. Both applications are owned by the same Assignee, O.F. Mossberg & Sons, Inc., located in North Haven, Conn. USA.

The present device offers an alternative method of clamping extra, interchangeable barrels (e.g., 12) to such long guns (i.e., shotguns or rifles) where the long gun's configuration makes certain clamping locations difficult or impossible. This device applies where the extra, interchangeable barrels (e.g., 12) have a gas cylinder or lug (e.g., 16) on which to clamp, whereby clamping onto the cylinder or lug provides not only a means of attachment, but also superior stability for the attached second barrels.

Applicant's present invention can be thought of as a method of removably attaching a second, interchangeable barrel (e.g., 12) to a magazine tube (e.g., 18) of a fully assembled long gun 14 (i.e., shotgun or rifle). In its broadest form, that method comprises the following steps: a. removably mounting a display clamp (e.g., 10) onto the magazine tube; and b. removably mounting a gas cylinder (e.g., 16) of the second barrel onto the clamp, whereby the second barrel is substantially parallel to the barrel (e.g., 36) of the assembled shotgun.

A more detailed method would be: a. mounting a display clamp (e.g., 10) on the magazine tube (e.g., 18); b. removably holding the clamp onto the magazine tube by a removable (e.g., threaded) magazine cap (e.g., 20); c. slipping a gas cylinder or lug 16 of the second barrel onto part of the clamp (e.g., a barrel support 28); and d. removably holding the clamp onto the second barrel by a removable (e.g., threaded) retaining cap (e.g., 34).

Either method could also include an additional step: displaying the long gun 14 and attached barrel (e.g., 12) as a combination unit either vertically or horizontally oriented within display cases (e.g., 21).

It should be understood by those skilled in the art that obvious structural modifications can be made without departing from the spirit or scope of the invention. For example, the separate clamp bracket and barrel support could be integrally molded. Accordingly, reference should be made primarily to the accompanying claims, rather than the foregoing description and drawings, to determine the scope of the present invention.

I claim:

1. A method of removably attaching a second, interchangeable barrel to a magazine tube of a fully assembled long gun, wherein the method comprises:

a. mounting a display clamp on the magazine tube;

b. removably holding the clamp onto the magazine tube by a removable magazine cap;

c. slipping a gas cylinder of the second barrel onto a barrel support of the clamp; and d. removably holding the clamp onto the second barrel by a retainer cap.

2. The method of claim 1 wherein the long gun is a shotgun.

3. The method of claim 2 further including displaying the shotgun and attached second barrel as a combination unit vertically within a display case.

4. The method of claim 2 further including displaying the shotgun and attached second barrel as a combination unit horizontally within a display case.

5. A method of removably attaching a second, interchangeable barrel to a magazine tube of a fully assembled shotgun, wherein the method comprises:

a. mounting a display clamp on the magazine tube of the shotgun;

b. removably holding the clamp onto the magazine tube by a removable magazine cap;

c. slipping a gas cylinder of the second barrel onto a barrel support of the clamp;

d. removably holding the clamp onto the second barrel by a retainer cap; and e. whereby the attached second barrel is substantially parallel to a first barrel of the assembled shotgun.

* * * * *